US012502750B2

(12) United States Patent
Kyynäräinen et al.

(10) Patent No.: US 12,502,750 B2
(45) Date of Patent: Dec. 23, 2025

(54) ABRASIVE PRODUCT AND METHOD FOR MANUFACTURING ABRASIVE PRODUCT

(71) Applicant: Mirka Oy, Jeppo (FI)

(72) Inventors: Niina Kyynäräinen, Salo (FI); Jan Grön, Vöra (FI); Peter Finnäs, Jakobstad (FI)

(73) Assignee: Mirka Oy, Jeppo (FI)

( * ) Notice: Subject to any disclaimer, the term of this patent is extended or adjusted under 35 U.S.C. 154(b) by 592 days.

(21) Appl. No.: 18/008,608

(22) PCT Filed: Jun. 9, 2021

(86) PCT No.: PCT/EP2021/065400
§ 371 (c)(1),
(2) Date: Dec. 6, 2022

(87) PCT Pub. No.: WO2021/250064
PCT Pub. Date: Dec. 16, 2021

(65) Prior Publication Data

US 2023/0249317 A1 Aug. 10, 2023

(30) Foreign Application Priority Data

Jun. 9, 2020 (GB) ..... 2008685

(51) Int. Cl.
*B24D 11/00* (2006.01)
*B24D 11/02* (2006.01)

(52) U.S. Cl.
CPC ..... *B24D 11/005* (2013.01); *B24D 11/02* (2013.01)

(58) Field of Classification Search
CPC ..... B24D 11/005; B24D 11/02
(Continued)

(56) References Cited

U.S. PATENT DOCUMENTS 5,674,122 A 10/1997 Krech
2019/0111543 A1* 4/2019 Kyynarainen ..... B24D 11/02

FOREIGN PATENT DOCUMENTS

CN 104797380 A 7/2015
EP 0 265 739 A1 5/1988
(Continued)

OTHER PUBLICATIONS

International Search Report and Written Opinion for International Application No. PCT/EP2021/065400, mailed Sep. 23, 2021.
(Continued)

*Primary Examiner* — James E McDonough
(74) *Attorney, Agent, or Firm* — Wolf, Greenfield & Sacks, P.C.

(57) ABSTRACT

An abrasive product has a flexible abrasive area for abrading surfaces to be abraded and comprises: a fabric; a plurality of flexible loops protruding from the fabric towards the flexible abrasive area, wherein each loop is formed by a pair of bottom-half arcs, a pair of legs and a head, wherein the pair of legs connects the pair of bottom-half arcs with the head, the bottom-half arcs of the loops are interlaced in rows in the fabric and form rows of interlaced bottom-half arcs, wherein the legs and heads protrude from the fabric, the heads of the loops are interconnected with one another at a distance to the fabric such that the flexible abrasive area is at a distance to the fabric, and the heads of the loops are at least partially provided with abrasive particles and form the flexible abrasive area.

16 Claims, 6 Drawing Sheets

(58) Field of Classification Search
USPC ..... 51/293, 300
See application file for complete search history.

(56) References Cited

FOREIGN PATENT DOCUMENTS

| | | | |
|---|---|---|---|
| EP | 2 042 269 | A1 | 4/2009 |
| FR | 2 865 675 | A1 | 8/2005 |
| WO | WO 96/07509 | A1 | 3/1996 |

OTHER PUBLICATIONS

International Preliminary Report on Patentability for International Application No. PCT/EP2021/065400, mailed Dec. 22, 2022.

* cited by examiner

ABRASIVE PRODUCT AND METHOD FOR MANUFACTURING ABRASIVE PRODUCT

RELATED APPLICATIONS

This application is a national stage filing under 35 U.S.C. § 371 of international application number PCT/EP2021/065400, filed Jun. 9, 2021, which claims the benefit of patent application number GB 2008685.6, filed Jun. 9, 2020, each of which is herein incorporated by reference in its entirety.

TECHNICAL FIELD

The invention relates to an abrasive product and a method for manufacturing the abrasive product.

PRIOR ART

WO 96/07509 A1 discloses an abrasive product having a fabric and loops situated on a surface of the fabric and projecting from the fabric. Grinding agent is applied to the loops.

Such abrasive products were frequently used and yielded satisfying abrading results.

However, there is the desire to increase the quality and efficiency of abrading processes.

DESCRIPTION OF THE INVENTION

The object forming the basis of the present invention is to provide an abrasive product allowing for increased abrading efficiency (efficiency of abrasive processes) and abrading quality, optionally without compromising the lifetime of the abrasive product.

This object is solved by the invention having the features of the abrasive product of claim 1, namely an abrasive product having a flexible abrasive area for abrading surfaces to be abraded, the abrasive product comprising: a fabric; a plurality of flexible loops protruding from the fabric towards the flexible abrasive area, wherein each loop is formed by a pair of bottom-half arcs, a pair of legs and a head, wherein the pair of legs connects the pair of bottom-half arcs with the head, the bottom-half arcs of the loops are interlaced in rows in the fabric and form rows of interlaced bottom-half arcs, wherein the legs and heads protrude from the fabric, the heads of the loops are interconnected with one another at a distance to the fabric such that the flexible abrasive area is at a distance to the fabric, and the heads of the loops are at least partially provided with abrasive particles and form the flexible abrasive area.

This object is also solved by the method of manufacturing the abrasive product according to claim 10, namely a method of manufacturing an abrasive product having a flexible abrasive area for abrading surfaces to be abraded, optionally the abrasive product of the invention, the method comprising the following steps: Preparing a fabric comprising a plurality of flexible loops protruding from the fabric towards the flexible abrasive area, wherein each flexible loop is formed by a pair of bottom-half arcs, a pair of legs and a head, wherein the pair of legs connects the pair of bottom-half arcs with the head, wherein this step includes interlacing the bottom-half arcs of the loops in the fabric in rows to form rows of interlaced bottom-half arcs, wherein the legs and heads protrude from the fabric, and interconnecting the heads of the loops with one another at a distance to the fabric to form rows of interconnected heads; and providing at least partially to the interconnected heads abrasive particles so as to form the flexible abrasive area at a distance to the fabric.

The invention is based upon the idea of interconnecting protruding heads of loops at a distance (i.e. spaced from or outside) the (base) fabric, wherein the loops, particularly the protruding heads of the loops, are coated with abrasive particles, wherein the loops, particularly the legs thereof, are flexible. The interconnection of the heads of the loops may provide a coherence between the plurality of protruding heads and, by way of such interconnection of the loops, a coherent abrasive area or surface. Thus, almost the entirety of the abrasive area can be in contact with the surface to be abraded (the workpiece), meaning that almost each of the loops contributes to the abrasive area and, allows for an efficient abrading process.

The abrasive area may be at a distance or elevated compared to the plane formed by the (base) fabric, wherein the elevation or distance between the plane defined by the (base) fabric and the abrasive area defined by the heads of the loops is mainly determined by the length of the legs of the loops. The legs of the loops provide for the distance between the fabric and the abrasive area represented by the interconnected and protruding heads.

Interconnecting the protruding heads helps the heads to remain erected as adjacent (neighboured) loops would help to pull a depressed loop back to its erected position.

Hence, the interconnection of the heads of the loops supports the presence of a coherent abrasive area.

Due to the interconnection of the loops, wherein the loops (particularly the legs thereof) are at the same time flexible, it is possible for the abrasive area to adapt to irregularities of a surface to be ground, i.e. of the workpiece, so that improved abrading results can be achieved also for uneven surfaces. In particular, as the loops are flexible, loops indeed subjected to an irregularity (such as a protrusion in the surface to be ground) will adapt and respond to the irregularity by depressing (giving in, i.e. reducing the distance to the fabric). Basically, the distance between the fabric and the interconnected heads provides for the maximum amount for potential depression of a loop. The neighboured loops, however, may be depressed only to a very limited extent. The reason may be the flexibility of the individual loops, which preferably results in a point elasticity of the abrasive area. This supports that neighboured loops may (almost) not be depressed and may remain in contact with the non-irregular (i.e. regular) surface immediately adjacent to the irregularity of the surface and, thus, may contribute to the abrading process of the non-irregular region of the surface to be ground. In other words, only loops that are immediately affected by an irregularity in a surface to be ground may be depressed; the remaining loops may be available for abrading the regular surface to be ground. The availability and contribution of the remaining loops to the abrading process may increase the abrading efficiency and quality further. If the interconnected loops are less flexible, a larger portion of the abrasive area may be affected by an irregularity in the surface to be ground, as loops adjacent to the loops directly affected by the irregularity may also be depressed and may, thus, not contribute to abrading the regular surface. The latter situation could be described as an abrasive area having surface/area elasticity (rather than point elasticity).

Hence, a difference relative to the prior art discussed above is that the loops according to the invention are not independent from each other, as the movability of the loops, particularly of the heads thereof, relative to each other is confined due to interconnection of the loops, but nevertheless the loops may be able to (almost) independently react to irregularities in the surface to be ground by depressing, due to the flexibility of the loops. Particularly in a direction in which the loops are not interconnected with one another, the loops are configured to give way and/or flex ("sideways").

For example, compression tests of a sample using a tensile testing machine have shown that area compression resistance (for a circular area having a diameter of 150 mm, measured in N) is about 5 to 10 times larger than point compression resistance (measured in N). The ratio between the point compression resistance and the area compression resistance may be different (lower, for example) for an abrasive product of the invention, which may reflect a desired point elasticity.

(Further) optional features are defined in the dependent claims:

Preferably, the abrasive product is obtained by interconnecting the heads of the loops so to form rows of interconnected heads, wherein further optionally, in the abrasive product, the interconnected heads of the loops form rows, even more optionally extending in the same direction as the rows of interlaced bottom-half arcs. This allows for a stable and reliable interconnection between the heads, while allowing for reliable abrading performance and/or easy manufacture.

Preferably, the rows of the interlaced bottom-half arcs (and optionally also the rows of interconnected heads) extend in the wale direction of the fabric. This provides for an efficient way of manufacturing. During manufacture, the rows of interlaced bottom-half arcs and/or the rows of interconnected heads may extend in the wale direction of the fabric and/or the rows of interlaced bottom-half arcs and the rows of interconnected heads may extend in the same direction.

Optionally, the fabric is impregnated and/or coated and/or flattened. This allows for stability in the product and improved abrading performance, as needed. During manufacture, before or after Step 2, the fabric may be impregnated and/or coated and/or flattened.

In preferred embodiments, the distance between the flexible abrasive area and the fabric is between 1 mm to 100 mm, preferably between 2 mm to 50 mm, and most preferably between 2 mm and 12 mm. This supports the desired flexibility.

Optionally, the heads of the loops and/or the fabric is/are coated with a coating based on latex, epoxy acrylates, polyester, melamine, polyurethane, phenolic resins, urea resins, acrylic resins and/or polyether acrylates. These coatings are reliable and long-lasting and provide the desired strength of the coating. During manufacture, before or after Step 2, the heads and/or the fabric may be coated with a corresponding coating.

Preferably, the abrasive particles have an average grit size between 1 μm and 1000 μm, preferably between 5 μm and 200 μm, more preferably between 10 and 100 μm. Also a range between 10 μm to 50 μm is considered. For applications, 10 to 30 μm have been tested. This provides the desired abrading results.

Specifically, using a mixture of different average grit sizes may be useful.

Optionally, the yarn count for the fabric is between 30 to 2000 dtex and/or the yarn count for the loops is between 5 to 200 dtex, preferably between 10 to 100 dtex, and more preferably between 20 to 50 dtex. This provides the desired strength of the product and, hence, the desired abrading strength and impact. Also, the geometrical sizes of the filament versus the abrasive grain size for applications suit this range.

The fabric may be laminated to one or more further layers, in particular a pliable layer, preferably a foam layer, an attachment layer for attachment to an abrading machine, preferably a grip velour, and/or a backing, preferably a PES woven textile or film. When manufacturing the abrasive product, after Step 2, the fabric may be laminated to one or more of these layers. This allows for the specific adaption of the abrasive product to a desired application and, hence, versatile applications.

Optionally, during manufacture, a double needle bar knitting machine is used for Step 1.

When the interconnected heads of the loops form rows and are unconnected in a direction perpendicular to these rows, the loops can bend towards the direction perpendicular to the rows formed by the loops, and, thus, give way and flex in this perpendicular direction.

The (base) fabric including the loops including the abrasive particles may be referred to as a (abrasive) pad. The pad may form with an optional further layer or further features etc. the abrasive product. Hence, if there are no further layers or features etc., the pad is the abrasive product, i.e. the abrasive product of claim 1.

The abrasive product may e.g. be an abrasive belt, an abrasive disc or a hand sanding article (such as an abrasive cleansing sponge). Use of the abrasive product as an abrasive belt, an abrasive disc or a hand sanding article is considered.

The terms "abrasive" and "abrading" may in particular embrace sanding, structuring, grinding, polishing and refining and/or rectification processes. These terms refer to the mechanical removal of material by way of abrasive particles (including abrasive grains), i.e. by way of abrasive agent (such as grinding agent).

The fabric is a textile fabric or cloth. It can be referred to as a base fabric or cloth. The plane in which the fabric extends can be regarded as a base plane of the abrasive product.

The fabric may be knitted or woven. Preferred fabrics forming the basis of the abrasive product are defined in ISO 8388 and comprise weft- and/or warp-knitted fabrics, preferably in the form of an atlas, tricot or cord binding, most preferable as weft-knitted jersey-based fabrics, weft-knitted double layer jersey-based fabrics, weft-knitted rib-based fabrics, weft-knitted purl-based fabrics, warp-knitted jersey-based fabrics, warp-knitted double layer jersey-based fabrics, warp-knitted rib-based fabrics, warp-knitted purl-based fabrics, combined warp- and weft-knitted jersey-based fabrics and others.

The fabric is preferably an open fabric, meaning that the fabric comprises openings, preferably, regularly arranged openings in the form of through holes. It is preferred that the abrasive product also comprises openings passing through the fabric. In other words, it is preferable that the abrasive product has an open fabric which remains open in the abrasive product. This allows air to pass through the abrasive product. This provides for cooling during the abrading process, as the surface to be ground is less prone to heat up. At the same time, by way of circulating air, dust may be removed from the surface being ground. This improves the abrading efficiency. However, it is not excluded that the fabric is a closed fabric, i.e. not open, and/or that the abrasive product is closed, i.e. not open.

Preferably, the form and the arrangement of the openings in the fabric are symmetric with respect to the wale direction of the fabric. This has the advantage that the fabric is very regular as such. By consequence, the abrasive area formed by the loops is very regular and a high quality surface finish can be provided.

Preferably, the openings are arranged in lines perpendicular to the wale direction of the fabric, wherein the openings are regularly spaced in the line direction and the lines are offset from one another with respect to the position of the openings. The regular spacing of the openings in the line direction might help that an even abrasive area is achieved in the width direction of the abrasive area. If the lines are offset from one another with respect to the position of the openings, the openings are not arranged in uniform rows along the wale direction. This may further diminish the occurrence of stripes on the abraded surface.

Thereby, it is further preferred that subsequent lines (i.e. lines that follow one another in the wale direction) are offset from one another with respect to the position of the openings. In this regard, it is furthermore preferable that the offset between subsequent lines is such that the openings of every second line align in the wale direction. If seen in the machine direction, the latter means, with other words, that a region coated with abrasives particles between two adjacent openings in one line is followed by an opening of the next line which is again followed by a region coated with abrasives particles of the second next line and so forth. Accordingly, this arrangement effectively suppresses the formation of stripes in the finished product if used for unidirectional grinding machines. Of course, also other patterns are conceived.

It is also conceivable that the fabric (and consequently the abrasive product) is not open, i.e. that it does not have openings.

The abrasive area is a region which includes abrasive particles and is used for abrading and in contact with the workpiece, i.e. the surface to be abraded, during abrading. The abrasive area represents (at least a part of) a surface and may be substantially planar.

The loops are flexible, meaning that at least a part of the loops is flexible. Preferably, at least the legs of the loops are flexible, which might mean that the legs are free from coating. This supports to render the abrasive area flexible. The abrasive product may be referred to as a flexible abrasive product. The material of the loops may be flexible.

The following may i.a. support the flexibility in the flexible loops and/or the flexible abrasive area: Material of the loops, kind of interconnection between the heads of the loops, length and thickness of the loops, particularly the legs thereof, and/or density of the loops. Also, the coating may affect the movability/flexibility, particularly of the region in which the yarns (i.e. the interconnection area) are interconnected.

The loops may be formed in many different ways, e.g. in connection with weaving or knitting the fabric. Hence, the loops may be integral parts of the fabric. In other words, the loops (particularly their heads) may be interconnected or "chained" with each other by knitting to each other. Preferably, the protruding heads of the loops are interconnected by being knitted to one another in the wale direction of the fabric, in particular by chaining protruding heads which succeed one another in the wale direction of the fabric. This way of interconnecting the loops provides for a very efficient way of achieving the desired configurational stability of the loops without hampering the dust-permeability of the product and without too much increasing the complexity for manufacturing. In addition, the chaining may readily be combined with various different binding patterns for the fabric and thus allows for an increased flexibility during manufacturing.

A typical number of loops (stitches) per square centimetre is 2-1000/cm$^2$, preferably 10-800/cm$^2$, more preferably 20-500/cm$^2$.

Preferably, the loop yarns are man-made or natural fibers comprising flat yarns, texturized yarns, magnetizable, metallic or hydrophilic yarns and/or combinations thereof.

Preferably, the loop yarns are/include monofilament yarns. Compared to multifilament yarns, which tend to be more bulky than monofilament yarns, the usage of monofilament yarns for the loops has the advantage that the pattern of the fabric is affected as little as possible if the loop yarns are worked into the fabric. This may bring about the benefit of a largely homogenous (or even) appearance of the fabric which is beneficial for many abrading applications. It is conceivable that one, two or even more monofilament yarns are used for the loops. Monofilament yarns can also be combined with multifilament yarns for the loops. A monofilament yarn may support resilience as needed.

The yarns of the fabric and the loop yarns are typically texturized or flat yarns of polyester or polyamide. However, yarns based on natural fiber such as cotton, hemp or similar fiber may also be suitable. Specifically, yarns made of renewable raw materials may be preferable, such as polylactide and bacterial polyhydroxyalcanoate. Such fibers may also be made from polymers composed of renewable building blocks made by fermentation and may also be only partly of renewable origin.

This includes in more general terms the use of so called staple fiber or multifilament yarns based on synthetic or natural fibers which can be used for the base structure or the reinforcement of the fabric. Twisted yarns being single or plied yarns can optionally also be used. Elastic yarns may be applicable in certain applications when the fabric shall be stretched in a specific way.

The term "texturized yarn", commonly known as DTY (Drawn Texturized Yarn), is a multifilament yarn which has been treated by thermal or mechanical methods or combinations thereof in a way that the yarn filaments are coiled, crimped or looped. There are various texturizing methods which can be applied, such as air texturized, knife edge texturizing, false twist friction texturizing, stuffer box texturizing or gear crimped yarn.

The term "flat yarn" is commonly known under the abbreviation FDY, which is so called Fully Drawn Yarn. Such FDY's can be of various build up types based on mono- or multifilament. These yarns can also be either bright, semi dull or full dull in respect to their appearance, which are the most common types. However also various shapes of yarns, filaments and their cross sections are available which amongst others can be for instance of the type round, trilobal, multi-edged or of any other type of shape.

Yarns of either type, such as texturized or flat yarn, can apart from their type of texturization, or shape and appearance additionally also be twisted. "Twisting" refers to turning the yarn into two different directions which are commonly referred to as "S" and "Z" directions. These directions of twist only refer to the direction in which the yarns are twisted; so that "S" and "Z" twisted yarns resemble mirror images of each other. Such twisting of yarn has in most cases barely any technical relevance in warp knitting, but leads to different optical effects in the final fabric.

A "plied yarn" typically consists of multifilament yarns, which can be twisted or non-twisted yarns, texturized or non-texturized yarns, as well as intermingled or non-intermingled yarns. Whereas typically twisted yarns are not intermingled. These previously described single yarns can then in the following be joined together to form a new, thicker, yarn which is referred to as being plied. Such a plied yarn consequently consists of at least two or more single yarns which have been plied together.

The term "natural fibers" refers to fibers which have an origin in renewable sources. These refer to fiber formed materials such as cotton, hemp, wool, silk or similar materials which are directly obtained from plants or animals.

The term "man-made fiber" is referring to all other fibers than natural fibers. Man-made fibers can be synthetically produced from petrochemicals, bio-based polymers or organic raw materials. Regenerated fibers are one subgroup under man-made fibers. Those are made of natural materials like plants by going through chemical and mechanical process. These kinds of fibers are e.g. Viscose, Bamboo and Modal type yarns which are made of cellulose. Synthetic fibers can be made of petrochemicals e.g. polyester, vinyl acetate, nylon, aramid and carbon. This category also includes chemically modified fiber formed materials and fibers manufactured from polymers of bio-based building blocks like for instance, lactic acid, amino acids or propylene dioxide based materials.

Examples of other potential yarns for fabrics for abrasive products include fibers of ultrahigh molecular weight polyethylene (UHMWPE), polypropylene (PP) and aramid yarns. These can be used for the base structure of the fabric or solely for the reinforcement of the material.

The yarn count of flat or texturized yarn may range from 5 to 4000 dtex, depending on the desired tensile and elongation values of the fabric as backing material, as well as the desired size of the abrasive particles or the end use of the final product. The unit "dtex" is by definition the weight in grams per 10,000 m of yarn. The typical yarn count for the fabric is between 30 to 2000 dtex. In this regard, the loop yarns preferably have a yarn count between 5 to 200 dtex and more preferably between 10 to 100 dtex, and even more preferably between 20 to 50 dtex.

The loops are formed by loop yarns which are interlaced in the fabric. On the one hand, this offers the advantage that the loop yarns may be chosen such that they suit the respective application. One the other hand, the loops can be formed independently of the fabric meaning that there are more degrees of freedom concerning the knitting pattern for the fabric.

According to an alternative way (which is also regarded as interlacing), the loops may also be formed by the yarns of the fabric, which has the advantage that no additional yarn species has to be supplied when manufacturing the fabric, thereby rendering the manufacturing process very economical.

The product is particularly easy to manufacture if the fabric and the loops are manufactured simultaneously by knitting, i.e. in one process step. This in particular applies to the features defined in Step 1 of the method claims.

According to a preferred embodiment, the protruding heads are respectively interconnected by threading the protruding head of one loop through the protruding head of another loop which precedes the one loop in the wale direction of the fabric. This constitutes a very effective way of interconnecting the loops outside of the fabric. Moreover, the loops are readily prevented from laying down since they are mutually interconnected in the wale direction of the fabric.

If combined with loops having their bottom-half arcs spaced by at least one stitch-row of the fabric, this provides the synergistic effect that the top ends of the loops are additionally prevented from "sliding down" the corresponding connecting loop (towards the fabric), since the connecting loop is held predominately open. Accordingly, this further contributes to a layer of loops which is very stable and very unlikely to collapse. In addition, the loops are more readily able to "recover" after having been pressed onto the fabric during manufacturing or shipping.

Interlacing the loop yarns by means of warp-knitting or weft-knitting offers a very effective and mechanically stable way of integrating the loop yarns in one single working process. The atlas, pillar, cord, or tricot bindings, in particular, offer an efficient way to optimally integrate the loops into the fabric without considerably limiting the degrees of freedom when designing the fabric.

Of note, the aforementioned bindings refer to the interlacing of the loops into the fabric and not to the way how the loops are interconnected outside of the fabric.

Particularly suited bindings for forming the fabric, for interlacing the loop yarns and for interconnecting the loops include pillar-, atlas-, cord-, tricot-, satin-, and inlay bindings and combinations thereof. Other bindings which are in principle suitable are defined in ISO 8388 and also comprise combined warp- and weft-knitted bindings.

Different types of impregnations and coatings may be applied to the fabric. Alternatively, the "pure" net-structure of the fabric can be used. With or without impregnations and coatings, the fabric may preferably be flexible.

The types of resins used for impregnations and coatings may consist of phenolic, urea or latex as well as blends thereof as described in EP 0 779 851. The fabric may be coated by using roller coating, spray coating, curtain coating, slurry coating, by printing methods such as screen printing or gravure rollers, transfer foil or similar methods resulting in coatings referred to as a make- and size-coat, wherein, spray and slurry coating are preferred.

Radiation curable impregnation resins such as epoxides, acrylates, or similar resins may also be applied. Also thermally curable epoxies, acrylates, isocyanides or similar resins and mixtures thereof may be utilized for the mechanical stabilization of the fabric. The resins may include fillers and additives such as surface-active substances like fatty acid ethoxylates, fillers or various kinds such as fibers, aluminum trihydroxide, kaolin, calcium carbonates, talc and the like.

The coating may provide an even base layer. Thereby, the coating can level out height-irregularities and further promote an even abrasive are. To this end, the coating may be specifically treated ("flattened") in order to form an even area/surface. As described in WO 2014/037034, this can be achieved by a specific way of applying the coating, e.g., by using a coating roller. Moreover, a flattening effect can be realized by pressing a flattening device against the not yet cured coating. In addition, there is the possibility of mechanically abrading or sanding the readily applied coating such as to level out (flatten out) any existing unevenness. Preferably, such flattening is carried out for the backside of the fabric, where no loops are present.

The abrasive area or surface may be strewn or coated with abrasive particles such as silicon carbide (SiC), aluminum oxide (AlOx) of various types (fused, sintered, sol-gel) or mixtures thereof, such as brown, pink, white, or high temperature treated species. Also alumina-zirconia, boron carbide, garnet, zirconia, chromia are conceivable. Hereby also high performance abrasives such as ceramic coated or similar grains as well as diamonds, CBN or other particles commonly referred to as super-abrasives can be applied.

The abrasive particles may be referred to as hard abrasive particles. Additionally or alternatively, soft abrasive particles or mixtures thereof are conceivable, such as cerium oxide (CeO), gamma alumina, silica, iron oxide, titanium oxide, tin oxide, recycled or volcanic glasses, pumice or wollastonite can be used, for example, for cleaning, polishing and furnishing applications. The soft abrasive particles may be characterized in that they have a hardness of below 7 on Mohs scale. Accordingly, hard abrasive particles may be characterized in that they have a hardness of 7 or higher on Mohs scale.

Abrasive particles formed as agglomerates of different shapes may also be used.

The coating for the abrasive particles, i.e. the coating for the abrasive area, can be made in different ways, the coating can comprise a separate make coat that separately bonds the abrasive particles. The coating can alternatively comprise a slurry of bonding agent and abrasive particles.

Turning to the composition of the coating, polymers are preferred. The coating may be based on standard oligomer and monomer-based acrylic formulations, water-dilutable acrylates, dual cure formulations, as well as Polyurethane-dispersions or similar materials. Further, also UV-curable epoxides and vinylmonomers are suitable materials. However acrylic oligomer/monomer-based formulations are preferred.

Typical coatings (for the fabric and/or the loops) are based on latex, epoxy acrylates, polyester, melamine, polyurethane or polyether acrylates. Particularly, phenolic, urea or acrylic resins may be suitable for binding the abrasive particles. Another type of binders are nano cellulose as such or in combination with other binders. The fabric and the loops (particularly the heads thereof) may have the same or difference coatings.

The abrasive particles may be provided only partially on the loops. For example, coating may be applied to primarily the heads of the loops, so that only the heads comprise abrasive particles, and the legs of the loops are substantially free from abrasive particles and/or coating. This helps to ensure that the loops (particularly the legs thereof) remain fully flexible and are not stiffened by a coating. Of course, also a flexible coating particularly for the legs is conceivable.

It is conceivable that the entire abrasive area is provided with abrasive particles. Alternatively, abrasive particles could be applied in an agglomerate manner, so that distinct islands of abrasive areas are defined on the abrasive area.

Specific properties of the product (such as the softness, the strength or the permeability for dust) can be readily adjusted by varying the thickness and stiffness of the fabric and the density of the loops per $cm^2$.

The abrasive product of the invention can additionally be provided with a loop structure on the backside of the fabric (pad). This would allow the abrasive product of the invention to be attached to a machine by way of hook and loop fastening, such as a sander, i.e. to hooks provided at the machine. The loops on the back side of the abrasive product may be interconnected or not. It is also conceivable that loops which are provided additionally on the backside of the fabric are coated with abrasive particles, for example having another grit size. This would allow, for example, for a hand sanding product having a coarse grit and a finer grit size.

Optionally, the abrasive product further comprises a soft or pliable layer which is laminated to the fabric (pad). Preferably, this layer is formed of a non-woven material, a foam material, a fabric material or combinations thereof. With such additional layer, the cushioning effect can be promoted. Moreover, such a layer may also be beneficial for wet sanding applications, since it may store water or aqueous solutions and release them over time during abrading.

Generally, the invention is applicable to wet and/or dry abrading processes.

All modifications as discussed in connection with the respective embodiments may be equally well applied in connection with the other embodiments, if possible.

BRIEF DESCRIPTION OF THE FIGURES

The invention may be better understood by reference to the following and taken in conjunction with the accompanying figures.

The description and the accompanying drawings are to be construed by way of example and not of limitation.

DETAILED DESCRIPTION OF PREFERRED EMBODIMENTS OF THE INVENTION

In the following, the invention is described in detail with reference to the drawings and specific examples of the invention.

Figure 1A:
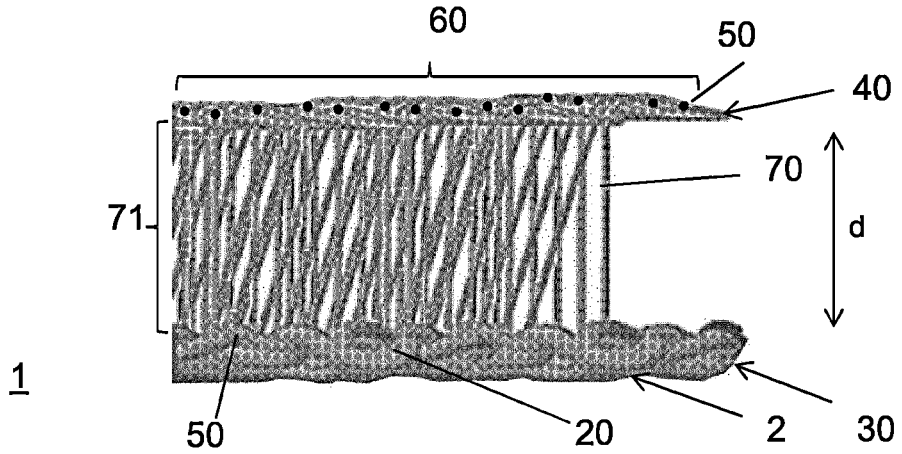
FIGS. 1A to 1D are schematic illustrations of an abrasive product of the invention.
Figure 1B:
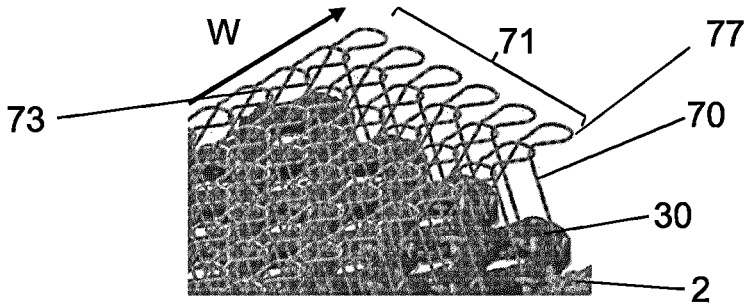

FIGS. 1A and 1B are schematic representations of an abrasive product 1 according to the invention. The abrasive product 1 comprises a (base) fabric or cloth 2 which constitutes the base layer of the abrasive product 1. The fabric 2 is a knitted textile fabric which is formed of knitted yarns 20 and can be produced on a textile producing machine by warp-knitting or weft-knitting, for instance.

The fabric 2 has a first side directed towards an abrasive area or surface 60 of the abrasive product, which is the upper side of the fabric 2 in FIG. 1A. On the first side of the fabric 2, a plurality of loops 71 which protrude from the knitted fabric 2 are formed. The loops 71 are formed of loop yarns 70.

To the loops 71, abrasive agents or abrasive particles 50 are applied so as to form the abrasive area 60. The fixation of the abrasive particles 50 can be promoted by a coating 40. This is shown in FIG. 1A, but has been omitted from FIG. 1B.

As indicated in the cross section of FIG. 1A, the abrasive area 60 in this example is coherent throughout the product 1, wherein the abrasive particles 50 are evenly distributed over the abrasive area 60. However, the abrasive area may also be incoherent, e.g., in the form of isolated spots or islands of abrasive particles.

The average grit size of the abrasive particles may be between 1 μm and 1000 μm, preferably between 5 μm and 200 μm, more preferably between 10 μm and 100 μm. Depending on the type of application, mixtures of different particle sizes can be used. In grinding applications, the grit size is defined according to desired grinding results, while the grit size may span over the whole range in cleaning or polishing applications.

Figure 1C:
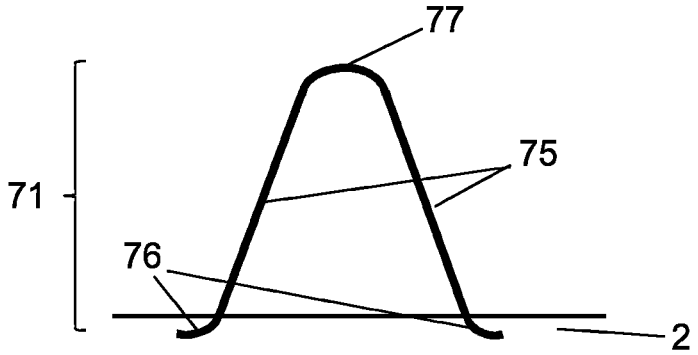

Referring to FIG. 1C, the relevant parts of the loops 71 are defined as follows: Each loop comprises a pair of bottom-half arcs 76 connected to a protruding head 77 by way of a pair of legs 75. With the bottom-half arcs 76, the loops are connected to the fabric 2 in the sense that these portions of the loops 71 are interlaced in the fabric 2. The protruding head 77 and the legs 75 are the portions of the loop 71 which actually protrude from the fabric 2, i.e., are arranged outside of the fabric 2. The protruding head 77 as well as the legs protrude from the fabric 2 towards the abrasive area 60.

In the example according to FIGS. 1A and 1B, the interconnection of the loops 71 is achieved by chaining the protruding heads 77 of the loops 71, which loops succeed one another in the wale direction W of the fabric 2 by threading the protruding head 77 of one loop 71 through the protruding head 77 of the preceding loop 71. However, other techniques—in particular, knitting techniques—may also be used for interconnecting the heads of the loops 71.

The loops 71 are arranged in rows, optionally in the wale direction W of the fabric 2, as the bottom-half arcs 76 of the loops are interlaced in rows in the fabric 2. This means that the bottom-half arcs 76 of the loops which succeed one another in a direction of the fabric (preferably the wale direction W of the fabric 2) form a row.

Further, as can be seen in the Figures, the heads 77 of the loops 71 are interconnected with one another in a plane essentially parallel to and spaced apart from the fabric 2. In other words, the protruding loops 71 are interconnected outside the fabric 2 and at a distance to the fabric 2. The interconnected loops form the abrasive area 60 which is positioned parallel and at a distance d to the plane of the fabric 2, see FIG. 1A.

Accordingly, the interconnected heads 77 may form rows 73 of interconnected loops, which rows 73 of interconnected heads may extend in the same direction as the rows formed by the bottom half arcs, preferably in the wale direction W of the fabric 2.

Figure 1D:
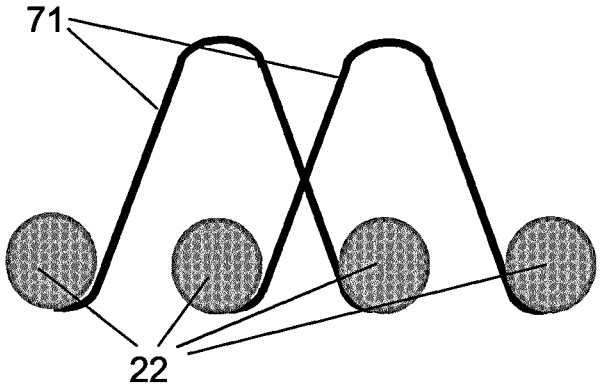

As can be seen from FIG. 1D, the bottom-half arcs 76 of each loop 71 are spaced apart from one another in the course direction of the fabric (which is perpendicular to the wale direction W). This has the effect that the loops are held "open", with the leg portions 75 being inclined against one another as they extend from the surface of the fabric 2. Hence, if the product is regarded in the wale direction W, the loops 71 have a V-shape or U-shape like configuration which narrows towards the heads 77. The inclination or tilting of the leg portions 75 (with respect to a normal line onto the fabric) can be adjusted by varying the spacing between the bottom-half arcs 76 and the contour length of protruding heads 77.

Due to the tilting of the leg portions 75 in counter directions, the product 1 becomes more resistant against shear forces.

Another effect is that the loops 71 can be kept relatively open which to some extent prevents that upon chaining the loops to one another the head or noose of one loop "slides down" the leg portions of the loop it is chained to. By consequence, this further promotes the dimensional stability of the loops 71 because they are less likely to collapse under mechanical impact and pressure. Moreover, the heads 77 are arranged essentially horizontally with respect to the fabric 2.

Preferably, the bottom-half arcs 76 of each loop are at least spaced by one stitch-row 22 of the fabric 2 and more preferably by two stitch-rows 22 of the fabric (c.f. FIG. 1D). The latter, in other words, means that the loop 71 spans over one stitch row 22 (c.f. FIG. 1D). In that case, it is particularly preferable if the loops 71 (or their protruding heads 77) alternatingly span one stitch-row 22 in the course direction (c.f. FIG. 1D).

In this regard, a stitch row 22 or wale is a stitch wale of stitches which proceeds over the length of the knitted fabric (c.f. ISO 4921:2000, 3.3.1). Exemplarily, the product 1 as described in FIG. 1 can be manufactured by using a double needle bar knitting machine for forming the abrasive product. This means, in other words, that the loops are held in a predominantly open configuration in a shape which resembles a V- or U-shape. Moreover, the loops are less prone to lay down and the resulting structure is more resistant.

The properties of the ensuing product can be adjusted by increasing the number of loop yarns, the number/thickness of filaments constituting a yarn and, correspondingly, the number of stitches with which the loops 71 are connected.

Figure 2:
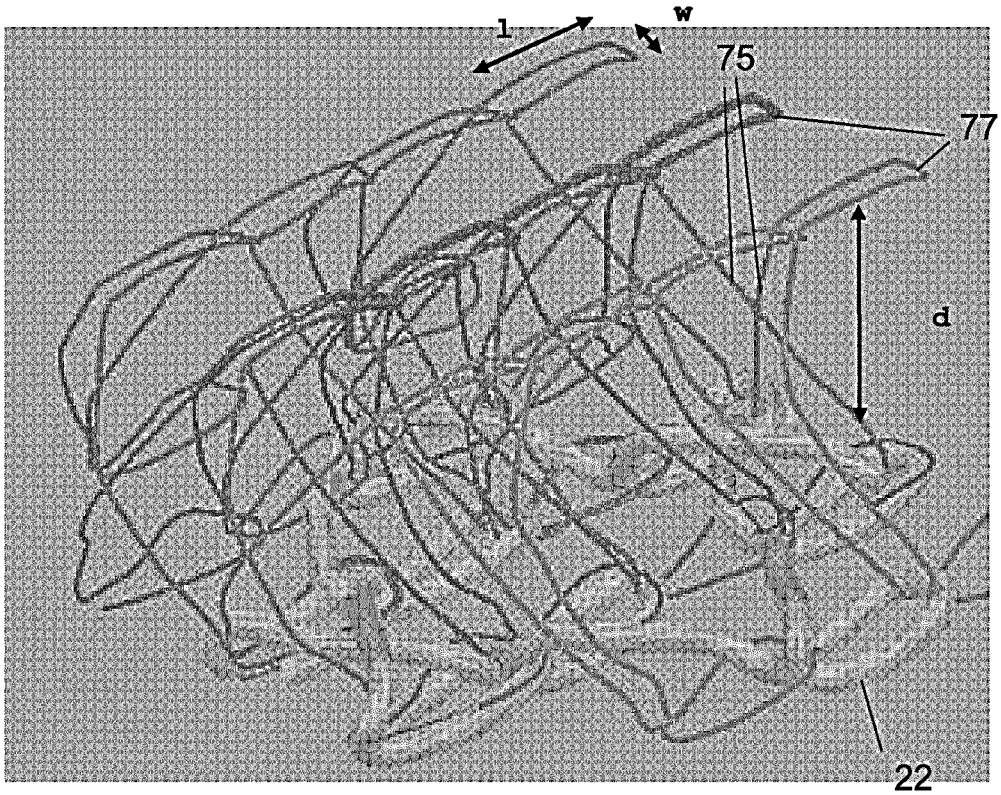
FIG. 2 is a schematic illustration of fabric yarns and loops yarns of an abrasive product of the invention.

FIG. 2 shows a schematic illustration of the yarns of the loops 71 and the yarns 20 of the fabric. The heads 77 are interconnected or chained with one another and form a plane (the abrasive area) which is basically parallel to the plane of the fabric. The distance between these two planes is referred to as distance d. The distance d may basically correspond to the length of the legs of the loops. The protruding legs 75 have a length of 1 mm to 500 mm, preferably 2 mm to 80 mm and most preferably between 2 mm and 20 mm. The distance d in the abrasive product between the abrasive area and the fabric is preferably between 1 mm to 100 mm, more preferably between 2 mm to 50 mm, and most preferably between 2 mm and 12 mm.

Each head of a chained loop may have a (contour) width w and a (contour) length 1. The length 1 may be in the wale direction W of the fabric, wherein the width w may be perpendicular to the wale direction W. Preferred dimensions for the heads of the loops are as follows: w:0.01 to 30 mm, preferably 0.1 to 20 mm, more preferably 0.2 to 10 mm; l: 0.05 mm to 30 mm, preferably 0.1 to 20 mm, more preferably 0.2 to 10 mm.

Figure 3A:
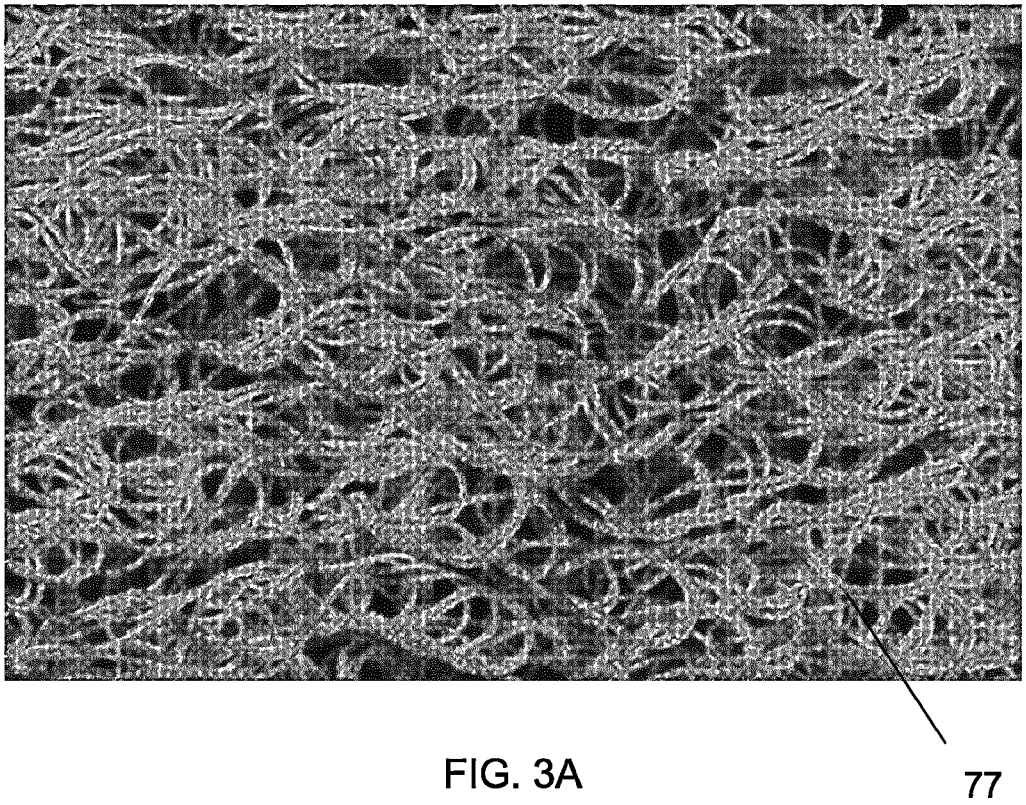
FIGS. 3A and 3B show microscopic pictures of coated loops of an abrasive product of the invention.
Figure 3B:
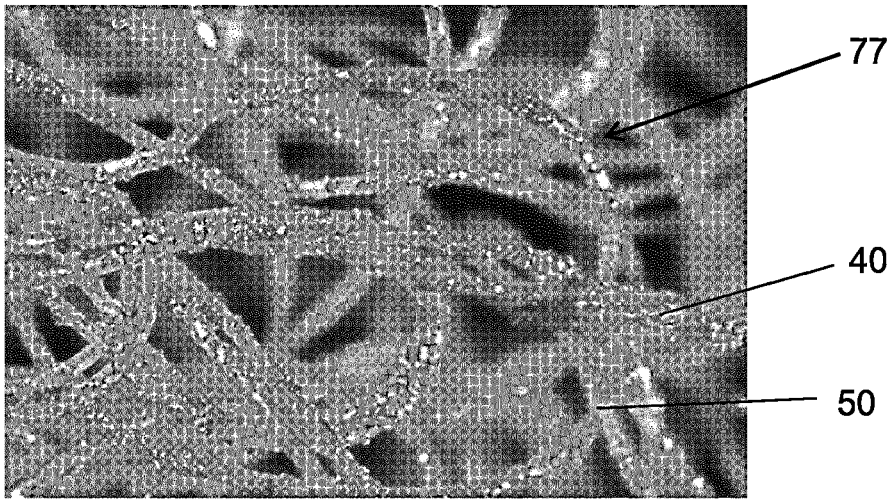

FIGS. 3A and 3B show microscopic pictures of an abrasive product of the invention, seen from above. These top views of the abrasive products show the interconnected heads 77 comprising abrasive particles 50 which are evenly distributed over the entire abrasive area. The heads 77 include coating 40 and abrasives 50.

Figure 4A:
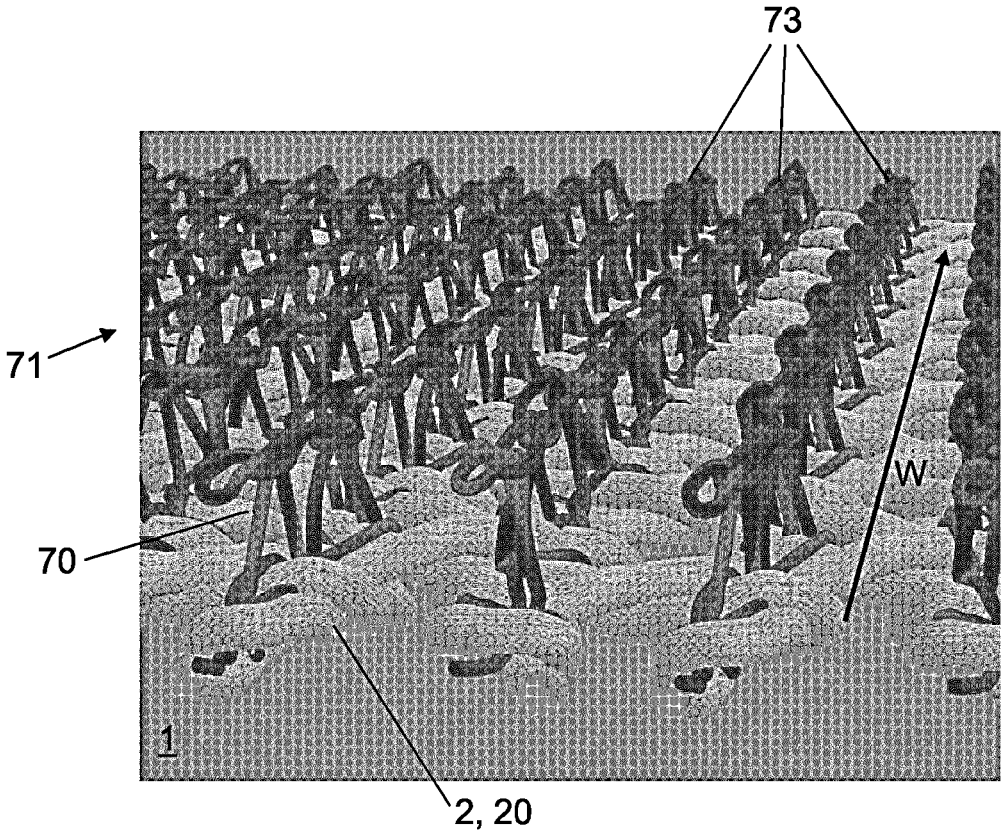
FIGS. 4A and 4B show an example for a knitting pattern for an abrasive product of the invention.
Figure 4B:
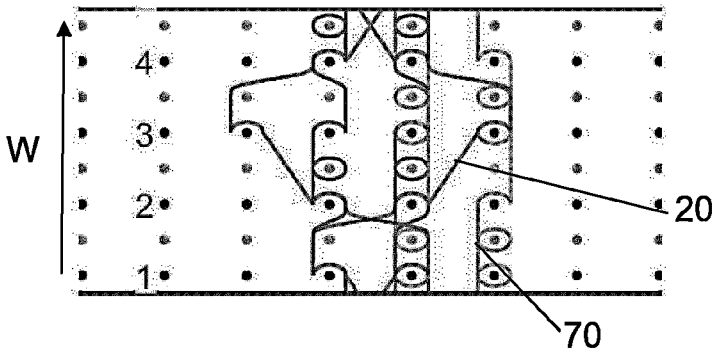

An example for such a textile structure according to the invention is shown in FIG. 4A and the corresponding yarn path notation in FIG. 4B in which black dots represent one needle bar of a double needle bar knitting machine and grey dots represent the other needle bar. As can be seen from the thread courses, the yarns 20 forming the fabric 2 are worked on one needle bar, while the loop yarns 70 are worked on both needle bars. The actual loops 71 of the loop yarns 70 are formed on the second needle bar (grey dots), however. In the example shown in FIG. 4B, the loops 71 are only connected in the wale direction W. There is no interconnection between the individual rows 73.

The fabric 2 is based on an (open) atlas binding and the interlacing of the loop yarns 70 is done by means of a pillar stitch—with the exception that a stitch is made on the second needle bar when the loops pass over the needles. Unlike the example which is shown in FIG. 1, the bottom-half arcs 76 of the individual loops are not spaced apart from one another in the course direction of the fabric, meaning that they are arranged in one and the same stitch row 22.

However, the loops 71 may also be knitted in the wale direction W of the fabric 2 so as to form rows 73 of interconnected loops 71 which extend in the wale direction W. Accordingly, the geometric stability of the loops 71 is enhanced and the loops 71 are less prone to lay down on the fabric. During subsequent process steps and/or storing, the interconnected loops might become irregular to some extent, so that the rows 73 might appear to be less easily discernible in the final product.

Figure 5A:
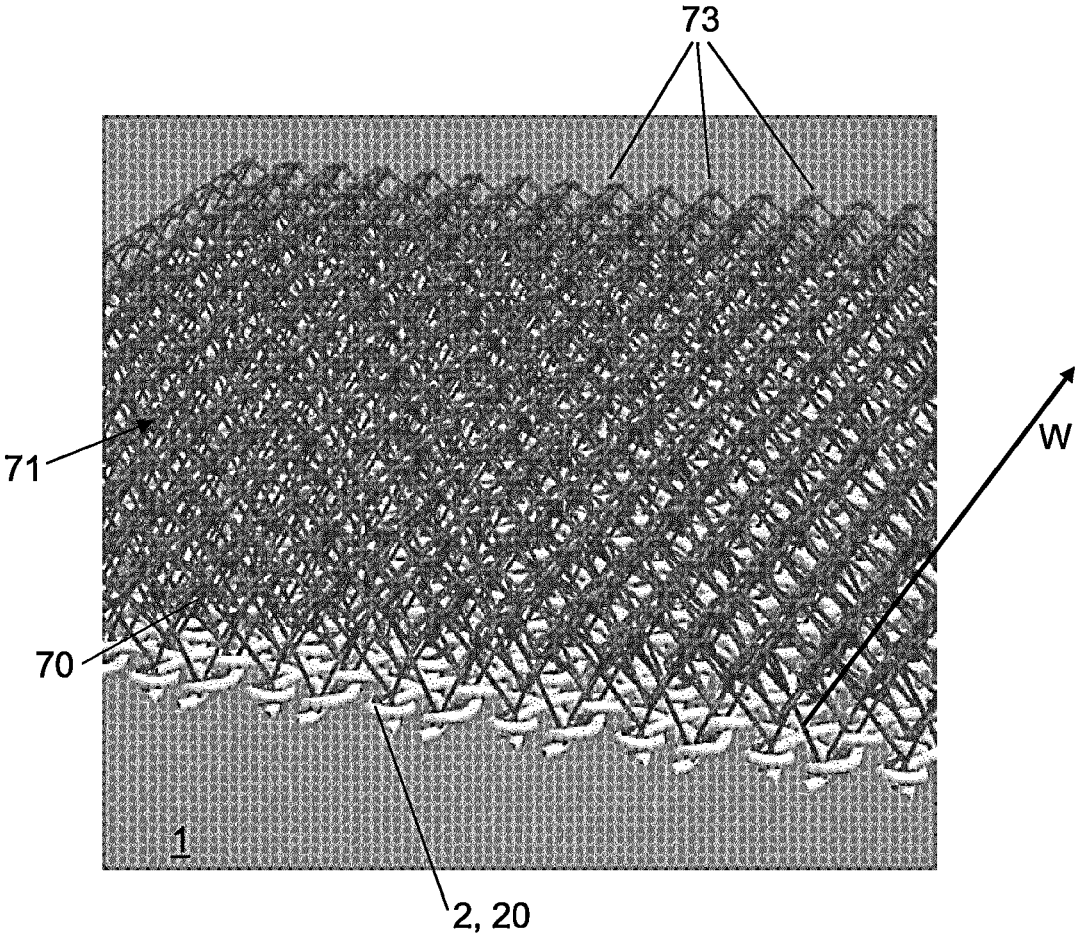
FIGS. 5A and 5B show another example for a knitting pattern for an abrasive product of the invention.
Figure 5B:
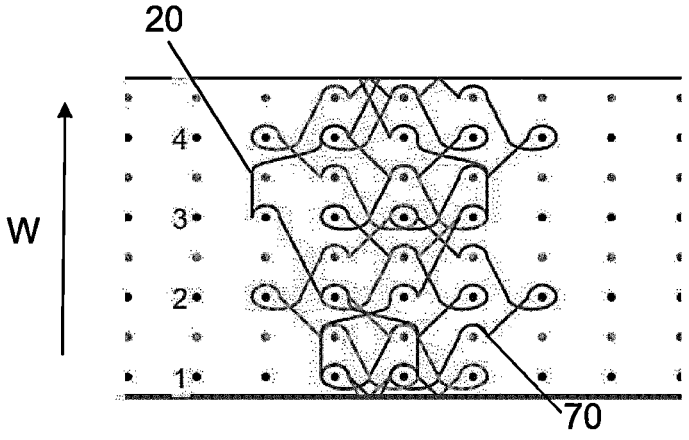

A further example for a concrete knitting pattern is shown in FIGS. 5A and 5B. As can best be seen from the yarn path notation of FIG. 5B, also the loop yarns 70 are interlaced in the form of an atlas binding. FIGS. 5A and 5B reflect that the loops do not only extend in the wale direction W of the fabric, but that the protruding heads alternatingly span one stitch row in the course direction of the fabric. This is clearly shown in FIG. 5B, where the pattern for the loop yarns 70 indicates a movement not only in the wale direction W, but also in the direction perpendicular to the wale direction W, namely the course direction (which is the left-right direction in FIG. 5B). By that, the loops which are arranged in the course direction may overlap one another in the sense that a bottom-half arc of one loop is arranged between the bottom-half arcs of the neighboring loops.

The fabrics 2 that are shown in the Figures are based on structures which are highly permeable due to a number of regularly arranged through holes in the base fabric 2. The open structure enables an optimal dust removal. When dust is created during sanding, the dust can easily be removed by air streams which penetrate through fabric 2 and the loops 71.

As illustrated in the Figures, it is possible to use different kinds of yarns for the loop yarns 70 and the yarns 20 of the fabric 2. This enables to use thinner yarns for the loop yarns 70 as compared to the yarns 20 of the fabric 2, for instance. The product as a whole can still be kept substantially open which is beneficial for dust removal and cooling. In addition, using thinner yarns for the loop yarns 70 ensures that the overall product is still soft and flexible. Moreover, this guarantees that no pronounced elevations in the fabric 2 result when the loop yarns 70 are worked on the same needle bar as the fabric 2.

In this regard, the loop yarns 70 preferably have a yarn count between 5 to 200 dtex and more preferably between 10 to 100 dtex, and even more preferably between 20 to 50 dtex.

Moreover, the loop yarns 70 may be formed of mono- or multifilament yarns while the yarns 20 forming the fabric 2 may be multifilament yarns. Also combinations of monofilaments and multifilaments can be used for each of the base fabric and the loops. Particularly for forming the geometrical shape of the loops, monofilaments are suitable, as they are usually stiffer and therefore create better geometrical stiffness, but multifilament yarns are conceivable for the loops for at least some applications.

An impregnation or coating 30 may be used for the fabric 2. Such coating may level any existing unevenness. Moreover, such coating also leads to a fixation of the loop yarns 70 in the fabric 2 which renders it difficult to pull out individual loops 71 from the fabric 2. The coating 30 may be applied from the side of the fabric 2, where the loops do not protrude (i.e. the backside of the fabric and of the abrasive product, i.e. the lower side of the fabric 2 in FIG. 1A).

In addition, the fabric and/or the loop yarns may comprise an impregnation for further enhancing the mechanical stability of the product.

The base fabric 2 including the loops 71 may be manufactured as described above in connection with FIGS. 4 and 5. A preferred direction for the rows of the bottom-half arcs and/or the rows of the interconnected heads is the wale direction of the fabric. However, any direction is conceivable. Afterwards, the fabric 2 may be impregnated and/or coated with the coating 30, to make it stiffer. Optionally, the coating 30 is flattened (from the backside) by one of the measures described above, such a using a roller and/or sanding.

Abrasive particles 50 are then applied to the heads 77 of the loops, by way of slurry coating (the abrasive particles 50 are in the coating 40) or a coating 40 is applied and afterwards abrasive particles 50 are provided, as described above. The coating 40 may serve as a primer for applying the abrasive particles 50.

In general, resin coating can be applied to the base fabric as an impregnation layer to achieve the desired stiffness in the base fabric. Resin coating to the loops is usually applied either as a make coat-strewing-size coat or as a slurry coating that is a combination of resin and abrasives.

When manufacturing the abrasive product according to the invention, in particular when proving the coating 40 and/or the abrasive particles 50 to the interconnected loops, rows formed by the interconnected heads may be affected and the order and regularity of the interconnected heads may be reduced. Due to such effects, the rows of interconnected heads may be harder to discern in the (final) abrasive product.

The fabric 2 may be worked further at its backside. For example, it may be laminated to a pliable layer (foam), a tape, backing or grip system. The backing is preferable for increasing the tensile strength and/or lowering the elongation properties, such as a PES woven textile or film.

As explained above, the "backside" or second side of the fabric may alternatively also comprise loops, for engagement with a hook-and-loop fastener for attachment to a machine, or coated with abrasive particles so as to obtain a two-sided abrasive product, as described above.

For the examples shown in the Figures and the below examples, the desired flexibility/movability of the loops is achieved, wherein at the same time, the interconnection of the heads provides for the desired coherence of the abrasive area. Hence, the abrasive products as described allow for improved quality and efficiency in abrading processes.

The abrasive product may in particular be an abrasive belt, an abrasive disc or a hand sanding article (abrasive cleansing sponge). The below examples 1 to 3 are only exemplary for these applications and do not limit the conceived abrasive belt, abrasive disc and hand sanding article to these specific examples.

Example 1

According to a first example, the invention is applied to a hand sanding product, such as an abrasive cleansing sponge. The fabric of an abrasive product in this form of the invention is optionally laminated to a foam, for example, a 3.5 mm polyurethane foam, with a polyurethane hot melt resin. The foam is provided on the side of the fabric which is free from loops, i.e. the opposite side of the side on which the loops forming the abrasive area are provided. Hence, the pad may be laminated to such foam layer.

SiC slurry coating has been provided to the heads of the loops. The grit size of the abrasive particles is P800 (FEPA). Preferably, the coating has a soft base coating, such as a latex coating.

An application for such hand sanding product can be the rectification of a stainless steel surface, for example. Typically, such hand sanding product is used for a wet abrasive process.

Example 1a

Another application within Example 1 is a cleaning sponge for removing stains or corrosion from a glass surface. The abrasive used here is a mineral comprising a mixture of hard and soft abrasive particles, such as (preferably recycled) crushed glass (such as with an average grit size below 25 μm and/or glass of recycled bottles, cans etc. or window glass), and cerium oxide (such as with an average grit range in the range 1.5-2.5 μm). The mixing ratio of hard abrasives (e.g. glass) and soft abrasives (e.g. cerium oxide) (in weight-%) may be between 0 and 100% (meaning 0% hard abrasives (glass) and 100% soft abrasives (cerium oxide); or 100% hard abrasives (glass) and 0% soft abrasives (cerium oxide)), but is preferably between 80 to 90% hard abrasives (glass) and 20 to 10%, respectively, soft abrasives (cerium oxide). The crushed glass removes the stains mechanically, while the cerium oxide polishes the glass surface. The binder for the mineral can be a polymeric binder or a nano cellulose or a combination thereof. The hard abrasives (crushed glass or mineral mixture) may be bound with a polymer binder while the soft abrasives (cerium oxide) may be bound with nano cellulose.

Example 2

According to a second example, the invention is applied to an abrasive belt (for belt sanding). For an abrasive belt, the fabric has (optionally) been impregnated with a resin formulation (for example based on SBR latex). Phenolic, acrylates or latex dispersions are conceivable. Optionally, the coated fabric has been sanded, in order to provide a well-defined structure.

The loops have been coated with a PF resin slurry with SiC or AlOx particles. The yarn count for the loops is 2×33 dtex, and for the base 2×78 dtex.

The back side of the belt was flattened by a flattening process (such as disclosed in WO 2014/037034 A1) and the ends of the belt were taped together from the back side with a thin polyester reinforced tape. This formed an endless belt for sanding. The technology disclosed in WO 2018/069574 A1 could be used for joining the ends of the belt. For belt sanding applications, usually dry sanding is performed.

Example 3

In a third example, the invention is used in an abrasive disc for an (random) orbital sander. Usually, a fastening aid, e.g. a grip velour, is laminated to the fabric with a hot-melt resin to allow for attachment to the sander. Such grip velour is laminated to the backside (i.e. the side of the fabric without loops) of the fabric (the pad). A disc is punched out from the laminated combination of the pad and the grip velour.

The abrasive particles may be SiC, grit size SiC P800 (FEPA). Dry sanding is carried out.

The invention claimed is:

1. Abrasive product having a flexible abrasive area for abrading surfaces to be abraded, the abrasive product comprising:

a fabric;

a plurality of flexible loops, wherein each loop is formed by a pair of bottom-half arcs, a pair of legs and a head, wherein the pair of legs connects the pair of bottom-half arcs with the head, the bottom-half arcs of the loops are interlaced in rows in the fabric and form rows of interlaced bottom-half arcs, wherein the legs and heads protrude from the fabric, the heads of the loops are at least partially provided with abrasive particles and form the flexible abrasive area, the plurality of flexible loops protrude from the fabric towards the flexible abrasive area and the heads of the loops are interconnected with one another at a distance to the fabric such that the flexible abrasive area is at a distance to the fabric.

2. Abrasive product of claim 1, wherein the abrasive product is obtained by interconnecting the heads of the loops so to form rows of interconnected heads, wherein optionally, in the abrasive product, the rows of interconnected heads extend in the same direction as the rows of interlaced bottom-half arcs.

3. Abrasive product of claim 1, wherein the rows of the interlaced bottom-half arcs extend in the wale direction of the fabric.

4. Abrasive product of claim 1, wherein the fabric is impregnated and/or coated and/or flattened.

5. Abrasive product of claim 1, wherein the distance between the flexible abrasive area and the fabric is between 1 mm to 100 mm, preferably between 2 mm to 50 mm, and most preferably between 2 mm and 12 mm.

6. Abrasive product of claim 1, wherein the heads of the loops and/or the fabric are/is coated with a coating based on latex, epoxy acrylates, polyester, melamine, polyurethane, phenolic resins, urea resins, acrylic resins and/or polyether acrylates.

7. Abrasive product of claim 1, wherein the abrasive particles have an average grit size between 1 μm and 1000 μm, preferably between 5 μm and 200 μm, more preferably between 10 μm and 100 μm.

8. Abrasive product of claim 1, wherein the yarn count for the fabric is between 30 to 2000 dtex and/or the yarn count for the loops is between 5 to 200 dtex, preferably between 10 to 100 dtex, and more preferably between 20 to 50 dtex.

9. Abrasive product of claim 1, wherein the fabric is laminated to a further layer, in particular a pliable layer, preferably a foam layer, an attachment layer for attachment to an abrading machine, preferably a grip velour, and/or a backing, preferably a Polyethersulfon woven textile or film.

10. Abrasive product of claim 1, wherein the abrasive particles comprise soft abrasive particles, preferably cerium oxide, bound by a coating comprising nano cellulose.

11. Method of manufacturing an abrasive product having a flexible abrasive area for abrading surfaces to be abraded, the method comprising:

Preparing a fabric comprising a plurality of flexible loops protruding from the fabric towards the flexible abrasive area, wherein each flexible loop is formed by a pair of bottom-half arcs, a pair of legs and a head, wherein the pair of legs connects the pair of bottom-half arcs with the head, preparing the fabric including:

interlacing the bottom-half arcs of the loops in the fabric in rows to form rows of interlaced bottom-half arcs, wherein the legs and heads protrude from the fabric, and interconnecting the heads of the loops with one another at a distance to the fabric to form rows of interconnected heads, and Providing at least partially to the interconnected heads abrasive particles so as to form the flexible abrasive area at a distance to the fabric.

12. The method of claim 11, wherein the rows of interlaced bottom-half arcs and/or the rows of interconnected heads extend in the wale direction of the fabric and/or the rows of interlaced bottom-half arcs and the rows of interconnected heads extend in the same direction.

13. The method of claim 11 wherein a double needle bar knitting machine is used in preparing the fabric.

14. The method of claim 11, further comprising impregnating, coating and/or flattening the fabric.

15. The method of claim 11, further comprising the heads and/or the fabric with a coating based on latex, epoxy acrylates, polyester, melamine, polyurethane, phenolic resins, urea resins, acrylic resins and/or polyether acrylates.

16. The method of claim 11, further comprising laminating the fabric to a further layer, in particular to a pliable layer, preferably a foam layer, an attachment layer for attachment to an abrading machine, preferably a grip velour, and/or a backing, in particular for increasing the tensile strength and/or lowering the elongation properties of the fabric, preferably a PES woven textile or film.

* * * * *